US005330663A

United States Patent [19]

Wollenberg et al.

[11] Patent Number: 5,330,663

[45] Date of Patent: Jul. 19, 1994

[54] NEUTRAL AND LOW OVERBASED ALKYLPHENOXY SULFONATE ADDITIVE COMPOSITIONS

[75] Inventors: Robert H. Wollenberg, Orinda; Richard J. Nelson, Pinole; John McDonald, Emeryville; Susanne G. Ruelas, San Pablo; Curtis B. Campbell, Hercules, all of Calif.; Kathryn E. Matera, Northford, Conn.

[73] Assignee: Chevron Research and Technology Company, San Francisco, Calif.

[21] Appl. No.: 938,779

[22] Filed: Sep. 2, 1992

[51] Int. Cl.[5] ..... C10M 159/24; C10M 135/10

[52] U.S. Cl. ..... 252/18; 252/33

[58] Field of Search ..... 252/18, 33

[56] References Cited

U.S. PATENT DOCUMENTS

| | | | |
|---|---|---|---|
| 2,483,501 | 10/1949 | McNab | 252/33 |
| 2,716,127 | 8/1955 | De Groote | 252/33 |
| 2,828,334 | 3/1958 | De Groote | 252/33 |
| 3,169,987 | 2/1965 | Bloch et al. | 260/505 |
| 3,422,161 | 1/1969 | Lavigne et al. | 252/33 |
| 3,470,097 | 9/1969 | Lavigne et al. | 252/33 |
| 3,483,262 | 12/1969 | Alul et al. | 260/624 |
| 3,487,023 | 12/1969 | Sweeney | 252/161 |
| 3,523,898 | 8/1970 | De Vault | 252/33 |
| 3,576,896 | 4/1971 | Luberoff et al. | 260/671 |
| 3,647,899 | 3/1972 | Straus | 260/668 |
| 3,666,825 | 5/1972 | Torck et al. | 260/671 R |
| 3,705,202 | 12/1972 | Massie | 260/671 C |
| 3,764,533 | 10/1973 | Hunt et al. | 252/33 |
| 3,775,325 | 11/1973 | Kerfoot et al. | 252/59 |
| 4,219,686 | 8/1980 | Petrillo et al. | 585/24 |
| 4,251,379 | 2/1981 | Le Coent et al. | 252/33 |
| 4,302,342 | 4/1981 | Demoures et al. | 252/33.2 |
| 4,328,111 | 5/1982 | Watson et al. | 252/33.4 |
| 4,358,628 | 11/1982 | Slaugh | 585/455 |
| 4,751,010 | 6/1988 | Leone et al. | 252/33 |
| 4,929,584 | 5/1990 | Slaugh et al. | 502/112 |
| 4,933,485 | 6/1990 | Buckley | 560/159 |
| 4,950,810 | 8/1990 | Kinishi et al. | 568/790 |

FOREIGN PATENT DOCUMENTS

| | | |
|---|---|---|
| 2606105 | 6/1977 | Fed. Rep. of Germany . |
| 1332473 | 10/1973 | United Kingdom . |
| 1372532 | 11/1973 | United Kingdom . |

OTHER PUBLICATIONS

Weaver, et al., Catalysis 1987, J. W. Ward, Editor, pp. 483–489, Elsevier Science Publishers, B. V. Amsterdam, Netherlands, (1988).

Baumgartner, Industrial and Engineering Chemistry, vol. 46, No. 6, pp. 1349–1352 (1954).

Korenev, et al., "Effect of Alkylphenols on Colloidal Structure of Detergent-Dispersant Additives", pp. 32–33, May 1992.

*Primary Examiner*—Jerry D. Johnson

*Attorney, Agent, or Firm*—Burns, Doane, Swecker & Mathis

[57] ABSTRACT

This invention is directed to neutral and low overbased alkylphenoxy sulfonates having a dialkyl content sufficient to provide an essentially neutral alkylphenoxy sulfonate having a viscosity no greater than about 1000 cSt at a temperature of 100° C. in the presence of 40 weight percent diluent oil.

32 Claims, No Drawings

NEUTRAL AND LOW OVERBASED ALKYLPHENOXY SULFONATE ADDITIVE COMPOSITIONS

BACKGROUND OF THE INVENTION

1. Field of the Invention

This invention is directed to neutral and low overbased alkylphenoxy sulfonate additive compositions which, at equivalent amounts of diluent oil, have lower viscosities as compared to comparable products known in the art.

2. State of the Art

During operation, the lubricating oil employed in automobile engines accumulates sludge and other harmful deposit forming materials which, if left untreated, would greatly reduce the operating life of the engine. Typically, however, dispersant and detergent additives are added to the lubricating oil to disperse the deposit forming material so as to retard or remove deposit formations. Such additives include, by way of example, alkenyl succinimides, overbased phenates, including overbased sulfurized phenates, neutral and overbased sulfonates, including neutral and low overbased alkylphenoxy sulfonates, and the like. These additives are typically employed in a variety of combinations so that the lubricating oil formulation contains more than one dispersant or detergent to control and/or remove deposit formation.

Of particular interest are neutral and low overbased alkylphenoxy sulfonate additive compositions which are useful in providing detergency and dispersancy properties to lubricating oil compositions. Specifically, it is known that neutral and low overbased alkylphenoxy sulfonates provide for improved control of piston deposits during diesel engine operation as compared to highly overbased alkylphenoxy sulfonates. In addition, low overbased alkylphenoxy sulfonates provide a measure of alkalinity reserve, albeit small, which is useful in neutralizing acids generated during engine operation especially when engines are operating on sulfur containing fuels.

The formation of neutral and low overbased alkylphenoxy sulfonate additive compositions by alkylation of phenol, sulfonation of the alkylated phenolic compounds and subsequent neutralization of the alkylphenol sulfonic acid by at least a stoichiometric equivalent of an alkaline earth metal oxide are, in a very general sense, known in the art.

For example, British Patent Specification No. 1 332 473 discloses the preparation of neutral alkylphenoxy sulfonate additive compositions and further discloses conversion of these materials to overbased alkylphenoxy sulfonate additive compositions (i.e., having a TBN of about 200 or more).

Similarly, U.S. Pat. No. 4,751,010 discloses the preparation of neutral and overbased alkylphenoxy sulfonate additive compositions useful as detergent-dispersant additives in lubricating oils. The disclosed preparation involves the neutralization of an alkylphenoxy sulfonic acid, followed by sulfurizing/overalkalinizing the salt obtained and then carbonating the resultant salt.

Similarly, French Patent No. 2,584,414 relates generally to detergent-dispersant lubricant additives prepared from alkylphenol sulfonic acid by neutralization, sulfurization, overbasing, and carbonation.

While neutral and low overbased alkylphenoxy sulfonate additive compositions are well known in the art, the preparation of these compositions has been substantially hindered by the fact that certain alkylphenoxy sulfonic acids, used as intermediates in the preparation of neutral and low overbased alkylphenoxy sulfonate additive compositions, are unstable at high temperatures (e.g., >50° C.) and/or during prolonged storage/shipment and this instability can result in spontaneous desulfonation. This problem is compounded by the fact that the preparation of alkylphenoxy sulfonic acids by sulfonation of the alkylphenol is generally conducted at elevated temperatures (e.g., 50° C.) and by the fact that it is common to store and/or ship these alkylphenoxy sulfonic acids at ambient conditions over long periods of time. In either case, a significant amount of the alkylphenoxy sulfonic acid can spontaneously desulfonate under these conditions.

Additionally, the commercial utility of neutral and low overbased alkylphenoxy sulfonate additive compositions is hindered by the fact that when prepared by current methodologies, these compositions can possess unacceptably high viscosities which require the further addition of large amounts of diluent to reduce the viscosity prior to the use of these compositions in formulating a complete lubricant package.

Specifically, neutral and low overbased alkylphenoxy sulfonate additive compositions have been typically prepared by first preparing the alkylphenol which is conventionally prepared by combining an excess amount of phenol with an olefin or alcohol in the presence of an acidic alkylation catalyst typically having a Hammett ($H_o$) acidity function of about −2.2 or greater (more positive) and an acid number of about 4.7 milliequivalents or less. Such acidic alkylation catalysts include cross-linked polystyrene sulfonic acid resins (e.g., Amberlyst TM 15 resin, available from Rohm & Haas, Inc., Philadelphia, Penna. and which has an $H_o$ value of −2.2 and an acid number of about 4.7 milliequivalents per gram). The resulting alkylphenol is then sulfonated by conventional methodology to form the alkylphenoxy sulfonic acid which, in turn, is reacted with either a stoichiometric or excess amount of an alkaline earth metal oxide in the presence of minimal diluent oil. After completion of the reaction, additional diluent (e.g; diluent oil) is generally added. In any event, because of transport cost considerations, the resulting product preferably should contain no more than about 40 weight percent diluent oil. Under these conditions, however, the viscosity of the neutral alkylphenoxy sulfonate additive composition prepared by prior art techniques is significantly greater than about 1000 cSt at 100° C. and the viscosity of the low overbased salts, while somewhat less than that of the neutral salt, is nevertheless unacceptable.

Consequently, with prior art neutral and low overbased alkylphenoxy sulfonate additive compositions, it is conventional to add further amounts of an appropriate diluent to the additive composition to reduce its viscosity to acceptable ranges or to employ a minor amount of the neutral and low overbased alkylphenoxy sulfonate in combination with a salicylate (see, for example, British Pat. Appl. No. 1 372 532). One diluent typically employed is heavily branched alkylate bottoms (BAB-bottoms) which, by virtue of its branching and relatively low viscosity, lowers the viscosity of the additive composition.

The further addition of a suitable diluent, such as BAB-bottoms, is undesirable because it requires an additional step in the process and increases the cost of the overall process by requiring a component whose primary function is to reduce the viscosity of the additive composition. Likewise, the inclusion of a salicylate additive with a minor amount of a neutral or low overbased alkylphenoxy sulfonate is undesirable because it limits the formulator to using a salicylate in the lubricant composition particularly when the presence of salicylate is either unnecessary or undesirable.

In view of the above, neutral or low overbased alkylphenoxy sulfonate additive compositions having acceptable viscosities with minimal amounts of diluent or no salicylate would provide a significant advantage in the efficient use of these additive compositions. Additionally, neutral and low overbased alkylphenoxy sulfonate additive compositions prepared from alkylphenoxy sulfonic acids having improved stability against desulfonation would provide further advantages in the efficient manufacture, storage and shipment of these additive compositions.

SUMMARY OF THE INVENTION

This invention is based, in part, on the discovery that alkylphenoxy sulfonic acids containing substantially straight-chain alkyl group(s) provide for enhanced stability against spontaneous desulfonation as compared to alkylphenoxy sulfonic acids containing a branched-chain alkyl group.

This invention is further based, in part, on the discovery that the viscosity of neutral and low overbased alkylphenoxy sulfonate additive compositions can be reduced by controlling the degree of dialkylation of the phenol. Surprisingly, it has been found that controlled alkylation of phenol so as to produce an alkylated phenol having a higher dialkyl content as compared to the alkylated phenols heretofore typically used in preparing neutral and low overbased alkylphenoxy sulfonate additive compositions results in lower viscosities in these additives. It has been further found that the use of alkylated phenols containing a sufficiently high dialkyl content provides for neutral and low overbased alkylphenoxy sulfonates additive compositions of acceptable viscosity with minimal addition of diluent oil or other diluents whose primary function is to lower the viscosity of the additive composition.

Alternatively or complimentarily, it has been found that the viscosity of neutral and low overbased alkylphenoxy sulfonate additive compositions can be reduced or further reduced by employing an alkylphenol which is obtained by reacting an internal olefin or an internal alcohol with phenol. Surprisingly, the use of such alkylphenols results in still lower viscosities in the neutral and low overbased alkylphenoxy sulfonate additive compositions.

In view of the above, in one of its composition aspects, this invention is directed to lubricating oil soluble, low viscosity, neutral and low overbased alkylphenoxy sulfonate additive compositions having a viscosity of no more than about 1000 cSt at 100° C. when the composition contains 40 weight percent of diluent oil and wherein the alkyl group(s) on the alkylphenoxy sulfonate are substantially straight-chain.

In a preferred embodiment, the neutral and low overbased alkylphenoxy sulfonate additive compositions are obtained from alkylated phenols of the Formula I:

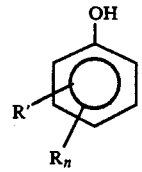

(I)

wherein R is a substantially straight-chain alkyl group containing a sufficient number of carbon atoms to render the resulting neutral or overbased alkylphenoxy sulfonate oil-soluble;

R' is hydrogen or a substantially straight-chain alkyl group of from 1 to about 7 carbon atoms; and n is a number sufficiently greater than 1 so that when the neutral alkylphenoxy sulfonate additive composition contains 40 weight percent of diluent oil, it has a viscosity of no greater than about 1000 cSt at a temperature of 100° C.

In a preferred embodiment, n is a number equal to or greater than about 1.10, and more preferably n is a number between about 1.12 and about 1.4.

In another preferred embodiment, the alkyl groups of the alkylphenoxy sulfonate are derived from internal olefins or internal alcohols.

In one of its method aspects, this invention is directed to a method for reducing the viscosity of a lubricant additive composition comprising neutral and low overbased alkylphenoxy sulfonates which method comprises the steps of:

(a) preparing an alkylphenol composition containing a dialkyl content of at least 10 percent wherein the alkyl group(s) of the alkylphenol are derived from substantially straight-chain olefins or alcohols having a sufficient number of carbon atoms to impart oil solubility to the alkylphenol;

(b) sulfonating the alkylphenol composition prepared in step (a) above so as to produce an alkylphenol sulfonic acid; and (c) reacting the product of step (b) with a sufficient amount of an alkaline earth metal base so that the resulting product has a TBN from 0 to about 100.

In a preferred embodiment, the neutral or low overbased alkylphenoxy sulfonate additive composition is prepared from an alkylphenol derived from internal olefins or alcohols.

DETAILED DESCRIPTION OF THE PREFERRED EMBODIMENTS

This invention is directed to novel neutral and low overbased alkylphenoxy sulfonate additive compositions which, at equal diluent oil concentrations, have surprisingly reduced viscosities as compared to neutral and low overbased alkylphenoxy sulfonate additive compositions heretofore produced. Furthermore, because these sulfonates contain alkyl R groups derived from substantially straight-chain olefins or alcohols, the neutral alkylphenoxy sulfonates have improved stability to desulfonation. However, prior to discussing this invention in detail, the following terms will first be defined:

Definitions

As used herein, the term "Total Base Number" or "TBN" refers to the amount of base equivalent to milligrams of KOH in 1 gram of additive. Thus, higher TBN numbers reflect more alkaline products and therefore a greater alkalinity reserve. The Total Base Number for an additive composition is readily determined by ASTM test method D664 or other equivalent methods.

The term "alkaline earth metal" or "Group II metal" means calcium, barium, magnesium, and strontium. Preferably, the Group II metal is selected from the group consisting of calcium, magnesium, barium, and mixtures thereof. Most preferably, the Group II metal is calcium.

The term "low viscosity" refers to neutral and low overbased alkylphenoxy sulfonate additive compositions having a viscosity of less than 1000 cSt at 100° C., preferably less than 500 cSt at 100° C. and more preferably less than 250 cSt at 100° C. when these additive compositions contain 40 weight percent diluent oil.

The term "neutral and low overbased alkylphenoxy sulfonate additive compositions" refers to compositions prepared by neutralizing an alkylphenol sulfonic acid with an alkaline earth metal base, such as an alkaline earth metal oxide, in the presence of diluent oil. The use of a stoichiometric equivalent (i.e., the exact amount of alkaline earth metal necessary to neutralize all of the alkylphenol sulfonic acid) provides for a "neutral" alkylphenoxy sulfonate; whereas an excess of alkaline earth metal so that the resulting product has a TBN of about 100 or less, and preferably about 50 or less, provides for a "low overbased" alkylphenoxy sulfonate.

As is apparent, the neutral and low overbased alkylphenoxy sulfonate additives described herein contain diluent oil and the term "neutral and low overbased alkylphenoxy sulfonate additive compositions" is defined to include such diluent oil. Typically, such compositions are manufactured to contain some diluent oil and, after manufacture, additional amounts of diluent oil are added to provide for an additive composition having from about 5 to about 40 weight percent diluent oil. As such, these additive compositions contain concentrated amounts of the alkylphenoxy sulfonate of which only a small amount is added together with other additives to a lubricating oil so as to provide for a fully formulated lubricant composition suitable for use in the crankcase of an internal combustion engine.

When the viscosity of the neutral or low overbased alkylphenoxy sulfonate additive composition is too high (i.e., 1000 cSt or higher at 100° C.), these compositions are difficult to manipulate (e.g., pour) in lubricant blending procedures used to prepare a fully formulated lubricant composition. Accordingly, in these circumstances, it is necessary to add additional amounts of low viscosity diluent to the additive composition so as to lower its viscosity thereby allowing for facile manipulation of the additive composition.

In this regard, the neutral and low overbased alkylphenoxy sulfonate additive compositions of this invention possess a viscosity at 100° C. in the presence of 40 weight percent diluent oil of less than 1000 cSt and, accordingly, do not require the addition of further amounts of low viscosity diluent to lower viscosity. In contrast, known neutral and low overbased alkylphenoxy sulfonate additive compositions derived from alkylphenols prepared by reacting an olefin or an alcohol with phenol in the presence of an acidic alkylation catalyst generally possess a viscosity at 100° C. and in the presence of 40 weight percent diluent oil greatly in excess of 1000 cSt. Under these circumstances, additional low viscosity diluent is necessarily added to lower the viscosity of such additive compositions so as to permit their facile manipulation during formulation procedures.

In regard to the above, the viscosity of neutral and low overbased alkylphenoxy sulfonate additive compositions of this invention will vary with temperature and diluent concentration. However, neutral and low overbased alkylphenoxy sulfonate additive compositions meeting this viscosity criteria at 100° C. and 40 weight percent diluent oil define a novel class of additive compositions which possess acceptable viscosity over a range of temperatures and a range of diluent oil concentrations.

The low overbased alkylphenoxy sulfonate additive compositions described herein have a Total Base Number of about 100 or less wherein all or part of the TBN is attributable to the excess of alkaline earth metal. Optionally, however, low overbased alkylphenoxy sulfonates can be prepared by using an equivalent or excess amount of alkaline earth metal and are then further treated with carbon dioxide and/or sulfur in a manner known per se provided that the total TBN is about 100 or less. Preferably, however, all of the TBN of the low overbased alkylphenoxy sulfonate is attributable solely to an excess of alkaline earth metal over that necessary to neutralize all of the sulfonic acid in the alkylphenol sulfonic acid.

The term "substantially straight-chain alkyl group" means an alkyl group which is attached to the phenolic ring through a secondary, tertiary or quaternary carbon atom and which contains minimal branching in the remainder of the carbon atoms of the alkyl group [i.e., less than 20% of the remaining carbon atoms are tertiary and/or quaternary carbon atoms in the molecular structure of the alkyl group]. Suitable substantially straight-chain alkyl groups include, for example, 1-decyl [$—CH_2(CH_2)aCH_3$] (0% of the carbon atoms are tertiary or quaternary carbon atoms), 4-methyl-1-decyl [$—CH_2(CH_2)_2CHCH_3(CH_2)sCH_3$] (9% of the carbons are branched), etc.

Preferably, the substantially straight-chain alkyl group contains less than 15% tertiary and/or quaternary carbon atoms in the remainder of the alkyl group; more preferably, less than 10%; still more preferably, less than 5%; and most preferably, the substantially straight-chain alkyl group contains no tertiary or quaternary carbon atoms in the remainder of the alkyl group.

Substantially straight-chain alkyl groups are preferably prepared by reacting phenol with either a substantially straight-chain alpha olefin, a substantially straight-chain alcohol, or a substantially straight-chain internal olefin or alcohol.

The term "olefin" refers to hydrocarbons containing a monoolefin group (C=C) within its structure.

The term "alcohol" refers to alkyl groups containing an —OH substituent.

The term "alpha olefin" refers to hydrocarbons containing a monoolefin group at one of the terminal portions of the hydrocarbon so as to terminate in a $CH_2=CH—$ group. Examples of alpha olefins include 1-decene [$(CH_2=CH(CH_2)TCH_3$], 1-hexadecene [$(CH_2=CH(CH_2)_{13}CH_3$], and the like.

The term "substantially straight-chain alpha olefin" means an alpha olefin which contains minimal branching [i.e., less than 20% of the carbon atoms are tertiary and/or quaternary carbon atoms] in the molecular structure.

The term "substantially straight-chain alcohol" means an alcohol which contains minimal branching [i.e., less than 20% of the carbon atoms are tertiary and/or quaternary carbon atoms] in the molecular structure.

The term "internal olefins" means an olefin wherein the double bond is at other than the 1, 2 or 3 position of the alkene; whereas the term "internal alcohol" means that the alkyl group contains the alcohol substituent at other than the 1, 2, or 3 position of the alcohol. By the same token, the term "internal attachment" implies that the olefin or alcohol attaches to the phenoxy group at a carbon other than the 1, 2 or 3 position of the alkyl substituent resulting from olefin or alcohol attachment to the phenol.

The term "dialkyl" or "dialkylated phenol" refers to phenols having two alkyl substituents which are capable of imparting oil-solubility to the neutral or low overbased alkylphenoxy sulfonate. In general, such substituents contain at least about 8 and preferably at least about 10 carbon atoms. Accordingly, excluded from this definition are alkyl substituents of 7 or fewer carbon atoms (e.g., methyl, ethyl, etc.) which do not impart such oil solubility. Thus, a 2-methyl, 4,6-didodecylphenol would be characterized as a dialkyl phenol for the purposes of this invention.

The term "oil solubility" means that the additive has a solubility of at least 50 grams per kilogram and preferably at least 100 grams per kilogram at 20° C. in a base 10W40 lubricating oil.

The term "substantially stable" as it relates to the stability of the alkylphenoxy sulfonic acid to spontaneous desulfonation means that less than 20% of the this composition will desulfonate when stored at 66° C. for 48 hours under the conditions of Example 5.

2. Methodology

The low viscosity, neutral and low overbased alkylphenoxy sulfonate additive compositions described herein are preferably obtained by neutralizing an alkylphenol sulfonic acid of Formula II:

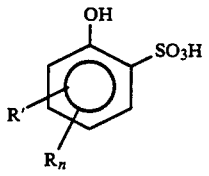

(II)

with at least a stoichiometric equivalent of an alkaline earth metal (e.g., alkaline earth metal oxide) wherein R, R' and n are as defined above.

In a more preferred embodiment, R comprises a substantially straight-chain alkyl group having at least about 8 carbon atoms and more preferably at least 10 carbon atoms. In a particularly preferred embodiment, R comprises a substantially straight-chain alkyl group having at least about 18 carbon atoms, and still even more preferably between 20 and 28 carbon atoms.

The neutralization reaction is conventional and is described by Leone et al., U.S. Pat. No. 4,751,010 which is incorporated herein by reference in its entirety. In general, the neutralization reaction involves the addition of a suitable amount of one or more alkaline earth metal bases such as alkaline earth metal oxides, hydroxides, carbonates, chlorides, etc., to the alkylphenol sulfonic acid. The reaction temperature is not critical provided that the reaction is conducted at a temperature sufficient to cause neutralization. Preferably, the reaction is conducted at a temperature of at least 55° C. and preferably from about 55° C. to about 140° C. an more preferably from about 55° C. to about 85° C. and is generally complete within about 1-6 hours.

The reaction is generally conducted in a diluent oil optionally in the presence of one or more inert diluent solvents, including by way of example, methanol, xylene, toluene, hexane, 2-ethylhexanol, oxoalcohols, decyl alcohol, tridecyl alcohol, 2-butoxyethanol, 2-butoxypropanol, the methyl ether of propylene glycol and mixtures thereof.

The amount of diluent oil employed is generally from about 5 to 40 weight percent of the total weight of the reaction mixture in the absence of inert diluent solvent whereas the amount of inert diluent solvent is generally an amount to ensure efficient mixing of the reagents. The diluent oil generally has a viscosity of from about 2 to about 10 cSt at 100° C. and is preferably, the same oil that will be used to prepare the fully formulated lubricating oil composition.

The neutralization can be catalyzed by means of carboxyl (COOH) ions from carboxylic acids, such as formic acid, acetic acid, glycolic acid; halogen ions, such as chlorides introduced by means of ammonium, calcium, or zinc chloride; or amine ($-NH_2$) functional groups such as polyethylene polyamines and tris(2-oxa-6-aminohexyl)amine. If a catalyst is used, the amount of catalyst used should be up to about 0.1 mole of carboxyl or halide ion or amine functional group per mol of initial alkylphenol sulfonic acid.

After reaction completion, the solids are generally removed by conventional means (i.e., filtration, centrifugation, etc.) and the inert diluent solvent is removed by conventional means such as stripping under reduced pressure. The recovered product is a neutral or low overbased alkylphenoxy sulfonate which is dissolved in diluent oil.

In an optional embodiment, the neutral or low overbased alkylphenoxy sulfonate additive composition described herein can be used to prepare low, moderately or highly overbased alkylphenoxy sulfonate additive compositions by first adding an excess amount of alkaline earth metal base to form the low overbased alkylphenoxy sulfonate, optionally adding sulfur, and then adding carbon dioxide. In general, from about 0 to about 1.5 equivalents of sulfur are added to the reaction mixture and the sulfur addition step is generally conducted at a temperature of about 100° C. to about 200° C. Likewise, from 0 to about 10 equivalents of carbon dioxide are generally then added to the reaction mixture and the carbonation step is generally conducted at from about 145° C. to about 180° C.

When the resulting composition has a TBN of about 100 or less, it is considered a "low overbased alkylphenoxy sulfonate additive composition"; whereas when the composition has a TBN of greater than about 100 and less than about 300, it is considered a "moderately overbased alkylphenoxy sulfonate additive composition"; and when the composition has a TBN of greater than 300, it is considered a highly overbased alkylphenoxy sulfonate additive composition. Preferably, the highly overbased alkylphenoxy sulfonates have a TBN of from about 300 to about 500.

It is contemplated that the highly overbased alkylphenoxy sulfonates will have a viscosity lower than that achieved by highly overbased alkylphenoxy sulfonates heretofore produced using conventional alkylphenol sulfonic acids. In this embodiment, calcium hydroxide or oxide is the most commonly used alkaline earth metal base and the addition of carbon dioxide can be preceded by the addition of sulfur to form a sulfurized low overbased alkylphenoxy sulfonate.

Methods for the addition of carbon dioxide and optionally sulfur to the alkylphenoxy sulfonates are well known in the art and are described, for example, by De Vault, U.S. Pat. No. 3,523,898; by Leone et al., U.S. Pat. No. 4,751,010; and by European Patent Application No. 0 003 694, the disclosures of each are incorporated herein by reference in its entirety.

At equivalent amounts of the same diluent oil, the neutral and low overbased alkylphenoxy sulfonates of this invention possess surprisingly lower viscosities as compared to prior art neutral and low overbased alkylphenoxy sulfonates. Additionally, when the neutral and low overbased alkylphenoxy sulfonates of this invention are prepared in the presence of at least 5 weight percent diluent oil, these additives are of sufficiently low viscosity that the further addition of supplemental low viscosity diluents is not necessary. This is especially surprising for the neutral alkylphenoxy sulfonates which have the highest viscosity (i.e., the viscosity of these additives increases as the TBN is reduced).

Alkylated Phenols

The alkylated phenols of Formula I can be obtained by known synthetic means and are then sulfonated by known means to provide for the compounds of Formula II.

Specifically, the alkylated phenols of Formula I can prepared by alkylation of phenol or a $C_1$ to $C_7$ alkyl substituted phenol using heretofore known alkylation methods for use in preparing neutral and low overbased alkylphenoxy sulfonates [e.g., combining an excess of phenol to olefin in the presence of an acidic alkylation catalyst having a Hammett ($H_o$) acidity function of about −2.2 or more (more positive) and preferably having an acid number of about of 4.7 milliequivalents per gram or less —such as Amberlyst TM 15 resin, available from Rohm & Haas, Philadelphia, Penna.]. Such reactions heretofore employed to prepare alkylphenols invariably produce less than about 5 weight percent of dialkylated product. Since these products have been heretofore used to prepare the neutral and low overbased alkylphenoxy sulfonates having unacceptable viscosity properties, this amount of dialkylated product is insufficient to provide the desired reductions in viscosity for the neutral and low overbased alkylphenoxy sulfonates described herein. However, in one embodiment, this alkylated phenol product can be separated into mono and dialkyl components using conventional separation techniques including gravity chromatography, high performance liquid chromatography, etc. The dialkylated products can then be used per se to prepare the neutral or low overbased alkylphenoxy sulfonates described herein or they can be recombined with controlled amounts of monoalkyl products to provide for an enriched dialkylated phenol product suitable for use in preparing the neutral or low overbased alkylphenoxy sulfonates described herein.

Alternatively and preferably, the alkylated phenol of Formula I is prepared by contacting an excess of phenol or a $C_1$ to $C_7$ alkylphenol with a suitable olefin or alcohol (generally at a charge mole ratio of about 3.5:1) in the presence of an acidic alkylation catalyst having a Hammett ($H_o$) acidity function of about −2.2 or less (less positive) and preferably having an acid number of about of 5.0 milliequivalents per gram or more. Suitable acidic alkylation catalysts include, by way of example, Nafion (a fluorocarbonsulfonic acid polymer heterogeneous acid catalyst available from DuPont, Wilmington, Del.), Amberlyst TM 36 resin (a sulfonic acid resin available from Rohm & Haas, Philadelphia, Penna.) and the like. This reaction is generally conducted at a temperature sufficient to alkylate the phenol and to also dialkylate a portion of the alkylated phenol.

The reaction is typically conducted in either a batch or a continuous process. In batch processes, the reagents are combined into a single vessel and the reaction is maintained at the selected reaction temperature for about 8 to about 10 hours. In a continuous process, a reagent stream containing the requisite amounts of olefin and phenol or $C_1$ to $C_7$ alkylphenol is passed through a stationary bed of acidic alkylation catalyst typically at a LHSV of from about 0.2 to about 0.5 $hr^{-1}$. In such processes, the contact time is generally from about 2 to about 5 hours and preferably around 3 hours.

In either case, after reaction completion, the product alkylphenol can be separated by conventional methods such as distillation, chromatography, and the like or used in the next step without further purification and/or isolation.

The monoalkylphenols prepared by this process have the alkyl substituents at either the 2 (ortho) or 4 (para) positions. The dialkylphenols prepared by this process have the alkyl substituents at either the 2,4-or the 2,6-positions. Preferably, monoalkylation is in the 4-position and dialkylation is in the 2,4-positions.

Surprisingly, at reaction temperatures greater than about 90° C. and preferably greater than 100° C., acidic alkylation catalysts having a Hammett ($H_o$) acidity function of about −2.2 or less (more negative) and preferably having an acid number of about of 5.0 milliequivalents per gram or more provide for products having sufficient dialkylation such that the neutral alkylphenoxy sulfonate additive composition containing 40 weight percent diluent oil and prepared from the resulting alkylphenol has a viscosity no greater than about 1000 cSt at a temperature of 100° C., and more preferably a viscosity no greater than about 500 cSt at a temperature of 100° C.

As shown in the examples hereinbelow, the extent of dialkylation is governed, in part, by the reaction temperature and, from these examples, the skilled artisan can control the degree of dialkylation. In any event, the reaction is preferably conducted at temperatures above about 90° C. to about 120° C. and even more preferably from about 100° to about 110° C.

Heretofore, acidic alkylation catalysts having a Hammett ($H_o$) acidity function of about −2.2 or less (less positive) and preferably having an acid number of about of 5.0 milliequivalents per gram (e.g., Nafion TM, Amberlyst TM 36, etc.) are not believed to have been used to prepare alkylated phenol for use in the preparation of neutral and low overbased alkylphenoxy sulfonate additive compositions.

The symbol n in Formula I is a number greater than 1 wherein the decimal represents the degree of dialkylation. In general, the amount of dialkylation is sufficient to provide for a neutral alkylphenoxy sulfonate having a viscosity of about 1000 cSt or less at 100° C.

Because the viscosity of low overbased alkylphenoxy sulfonate additive compositions are invariably less than that of the corresponding neutral alkylphenoxy sulfonate additive compositions, alkylated phenols having this degree of dialkylation provide for neutral and low overbased alkylphenoxy sulfonate additive compositions having viscosities which require the addition of substantially less or no diluents such as BAB-bottoms or the like to reduce the viscosity to a point where it can be readily manipulated for formulation purposes. This is especially surprising when it is considered that such a viscosity is achieved despite the fact that the TBN may be less than about 100, and, as indicated above, the TBN may be as low as approximately 0.

In a preferred embodiment, n is a number greater than about 1.10 and more preferably between about 1.12 and about 1.4. Most preferably, n is a number from about 1.15 to about 1.3.

When olefins or alcohols are employed to alkylate phenol or a phenol substituted with an R' group equal to 1 to 7 carbon atoms, the olefins or alcohols are substantially straight-chain olefins or alcohols. From an availability point of view, it is preferred that the olefins are substantially straight-chain α-olefins and alcohols have the —OH substituent at the 1-position.

Contrarily, from a viscosity point of view, it is contemplated that substantially straight-chain internal olefins and internal alcohols provide for enhanced internal attachment which, in turn, is believed to provide for reduction in viscosity as compared to end attachment. Thus, the alkyl group according to this embodiment of the present invention is attached at an internal carbon atom, i.e., other than the terminal 1, 2 or 3 positions from either end of the alkyl group. It is contemplated that use of such attachment may, by itself, result in neutral and low overbased alkylphenoxy sulfonates which have viscosities of less than 1000 cSt at 100° C. in the presence of 40 weight percent diluent oil. When internal attachment is employed in combination with enhanced dialkyl content, it is also contemplated that an incremental decrease in viscosity is achieved as compared to the decrease in viscosity resulting from use of enhanced dialkyl content alone.

Where the starting material is an α-olefin, this internal attachment can occur by migration of the carbonium ion formed from the α-olefin during alkylation.

Sulfonated Alkylated Phenols

The alkylated phenols of Formula I are converted to the alkylphenol sulfonic acids of Formula II by standard, well-known sulfonation chemistry. Specifically, the alkylphenol sulfonic acids of Formula II are prepared by reacting an alkylated phenol of Formula I with a suitable sulfonating agent, such as concentrated sulfuric acid, fuming sulfuric acid, chlorosulfonic acid or sulfur trioxide, for a period of time sufficient to effect sulfonation, and thereafter separating insoluble acid sludge from the oil soluble alkylphenol sulfonic acid of Formula II.

The oil-soluble, neutral and low overbased alkylphenoxy sulfonate additive compositions produced by the process of this invention are useful lubricating oil additives imparting detergency and dispersency properties when added to the lubricating oil composition employed in the crank case of an internal combustion engine. When employed in this manner, the amount of oil-soluble, neutral and low overbased alkylphenoxy sulfonates added to the lubricating oil composition ranges from about 0.5 to 40 weight percent of the total lubricant composition although preferably from about 1 to 25 weight percent of the total lubricant composition. Such lubricating oil compositions are useful in diesel engines, gasoline engines as well as in marine engines.

Such lubricating oil compositions employ a finished lubricating oil which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like.

The lubricating oils used in such compositions may be mineral oils or synthetic oils of viscosity suitable for use in the crank case of an internal combustion engine such as gasoline engines and diesel engines which include marine engines. Crank case lubricating oils ordinarily have a viscosity of about 1300 cSt at 0° F. to 24 cSt at 210° F. (99° C.). The lubricating oils may be derived from synthetic or natural sources. Mineral oils for use as the base oil in the invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of α-olefins having the proper viscosity. Especially useful are the hydrogenated liquid oligomers of $C_6$ to $C_{12}$ α-olefins such as 1-decene trimer. Likewise, alkylbenzenes of proper viscosity such as didodecyl benzene, can be used. Useful synthetic esters include esters of both monocarboxylic acids and polycarboxylic acids as well as monohydroxy alkenols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Other additives which may be present in the formulation include rust inhibitors, foam inhibitors, corrosion inhibitors, metal deactivators, pour point depressants, anti-oxidants, and a variety of other well-known additives.

The invention will be illustrated in greater detail by the following specific examples. It is understood that these examples are given by way of illustration only and are not meant to limit the disclosure of the claims to follow.

EXAMPLES

Example 1

Preparation of Low Overbased AlkylPhenoxy Sulfonates

A. Preparation of Alkylate Phenols

Low overbased (LOB) alkylphenoxy sulfonates were prepared using an alkylphenol derived by contacting 3.5 moles of phenol per each mole of a $C_{20}$ to $C_{24}$ alpha olefin mixture using either an Amberlyst-15 catalyst [a polystyrene cross-linked sulfonic acid resin having a Hammett acid function ($H_o$) of −2.2 and an acid number of 4.7 milliequivalents per gram], a typical prior art alkylation catalyst, or Amberlyst-36 catalyst [a polystyrene cross-linked sulfonic acid resin having a Hammett acid function ($H_o$) of less than −2.2 and an acid number of 5.4 milliequivalents per gram]. Both Amberlyst-15 and Amberlyst-36 resin catalysts are commercially available from Rohm & Haas, Philadelphia, Penna.

The alkylation reactions were conducted at 10° C. increments using a continuous alkylation unit such that the catalyst contact time was 3 hours and the LHSV was 0.33 $hr^{-1}$. The quoted column temperature was maintained as the average temperature measured at the lower third and the upper third of the reactor. Afterwards, the alkylated phenol was recovered by stripping the excess phenol from the product stream which optionally can be recycled for further use. The recovered alkylphenol products were analyzed for dialkyl content and ortho/para substitution by high performance liquid chromatography (HPLC) using a cyano column (Beckman 4.6 mm×25 cm Ultrasphere Cyano, Beckman Instruments, San Ramon, Calif.). The eluant employed was a solvent mixture comprising:

10 vol. % —2.5 volume % absolute EtOH in cyclohexane 10 vol. % —cyclohexane

The flowrate was 1.5 ml/minute and the sample concentration at the injection port was 0.01 volume percent in cyclohexane. The detection system comprised a UV/VIS detector set at a wavelength of 281 nm.

The results of this analysis are set forth in Table I below:

TABLE I

| Temperature (°C.) | % Dialkylation Amberlyst 15 | Amberlyst 36 |
|---|---|---|
| 80 | <3 | <1 |
| 90 | <4 | 6 |
| 100 | 4 | 11 |
| 110 | <3 | 15.5 |
| 120 | <2 | 15 |
| 130 | <4 | 13 |
| 140 | <3 | 19.5 |

The above data shows that at reaction temperatures of greater than about 100° C., alkylation with Amberlyst TM 36 catalyst provides for greater than 11 percent dialkylation whereas the prior art catalyst consistently provides about 4 weight percent or less of dialkylation.

Additionally, both catalysts gave essentially identical ratios of [ortho/(ortho+para)] isomers and these ratios were nearly independent of temperature over the range indicated.

B. Sulfonation of Alkylated Phenols

Alkylated phenols prepared in a manner consistent with Example 1A above (at 110° to 120° C.) were sulfonated by adding the appropriate alkylated phenol to a reaction flask immersed in a 55° C. water bath. Air was introduced into the reaction flask at a rate of 5 liters per minute. Sufficient $SO_3$ was added to the reaction flask at a rate of 0.157 ml/minute so as to provide a charge mole ratio of $SO_3$ to alkylated phenol of 1.1:1. After completion of the $SO_3$ charge, the reaction is maintained at 55° C. for 15 minutes. Cyclohexamine analysis for this product indicates that 81.64 weight percent of this product is the desired alkylphenol sulfonic acid.

C. Neutralization

Alkylphenol sulfonic acids produced in the manner similar to Step B above were neutralized with an excess of calcium hydroxide to provide for a low overbased alkylphenoxy sulfonate. Typically, 104.5 grams of alkylphenoxy sulfonic acid is charged to a 3-neck 2-liter flask as well as 64.4 g of diluent oil (CitCon 100N). To this system is added 500 ml of 1:1 methanol:xylene and 2.1 g of 40% calcium chloride. The system is then heated to about 40° C. and 8.42 g of $Ca(OH)_2$ is then added over a thirty minute period. The system is then heated to 60° C. and then 0.51 g of additional Ca(OH)2 is added and the system is maintained at 60° C. for 30 minutes. Afterwards, the system is heated to 80° C. and is maintained at this temperature for 1 hour; is heated to 100° C. and is maintained at this temperature for 1 hour. At this point, the methanol/water is removed. The system is then centrifuged at 6000 rpm for 30 minutes to remove insolubles and the liquid decanted off. Xylene is then removed by stripping under reduced pressure to provide for a low overbased alkylphenoxy sulfonate. Sufficient diluent oil (CitCon 100N) is then added to provide for low overbased alkylphenoxy sulfonates of approximately equivalent calcium concentration.

Different low overbased alkylphenoxy sulfonates were prepared by procedures similar to that recited above. These low overbased alkylphenoxy sulfonates were then analyzed for TBN values, weight percent calcium and viscosity at 100° C. The results of this analysis are set forth in Table II as follows:

TABLE II

| LOW OVERBASED ALKYLPHENOXY SULFONATES PREPARED FROM: | Alkylated Phenol from Amberlyst 15 | Alkylated Phenol from Amberlyst 36 |
|---|---|---|
| TBN | 5.6 | 7.0 |
| HYAMINE Ca | 1.91% Ca | 1.63% Ca |
| Analysis VIS (@ 100° C.) | 1787 cSt | 97.3 cSt |

The results of this example demonstrate that the high dialkyl content of alkylated phenols provides for low overbased alkylphenoxy sulfonates having significantly lower viscosities as compared to low overbased alkylphenoxy sulfonates prepared from alkylated phenols with low dialkyl content.

Further in regard to Example 1, the use of acidic alkylation catalysts having a Hammett acid function ($H_o$) of less than −2.2 and an acid number of at least 5.0 milliequivalents per gram is also disclosed in U.S. patent application Ser. No. 07/939,195 which application is incorporated herein by reference in its entirety.

Example 2

Preparation of Overbased Alkylphenoxy Sulfonate Additive Composition

Alkylphenol sulfonic acid produced in the manner similar to Step B of Example 1 above was neutralized with an excess of calcium hydroxide to provide for a low overbased alkylphenoxy sulfonate additive composition. In this example, 307.4 grams of diluent oil (CitCon 100N oil) is combined with 33.0 grams of lime in a 2 liter round bottom flask. The system is heated to 32° C. and then heated to 85° C. over a 30 minute period and then 358.7 grams of alkylphenoxysulfonic acid (3.31% calcium-sulfur by Hyamine analysis) is added dropwise via a dropping funnel to the reaction mixture. Upon complete addition, the system is heated to 95° C. over 15 minutes and then cooled to 85° C. At this point, 51.12 grams of 2-ethylhexanol is added over a 3 minute period. Then, 9.21 grams of calcium chloride in 21.34 grams of water is added over a 2 minute period, followed by addition of 3.88 grams of 1:1 formic acid:acetic acid over a 2 minute period.

Upon completion of this addition process, the system is refluxed at 95° C. for 1.5 hours. Afterwards, the diluents (other than CitCon 100N) are removed by distillation, first by heating to 121° C. over a 20 minute period and holding at this temperature for 15 minutes; and then by heating the system to 204° C. over 1 hour and stripping at 204° C. and 25 mm Hg for 1 hour to provide for a low overbased alkylphenoxy sulfonate additive composition.

Example 3

Preparation of Overbased Alkylphenoxy Sulfonate Additive Composition Containing Carbon Dioxide To a 2 liter, 4-neck round bottom flask were added 100 grams of methanol, 480 grams of xylene, and 90 grams of Mississippi Lime (Mississippi Lime Company, Ste. Genevieve, Mo.). The resulting system was stirred for 10 minutes. Afterwards, 266 grams of alkylphenoxy sulfonic acid [3.1% CaS by Hyamine analysis—prepared in a manner similar to that of Example 1, steps (a) and (b)] was slowed added to the system, over about a 1.5 hour period, while maintaining a maximum temperature of 31° C.

At this point, carbonation was initiated and approximately 28 grams of carbon dioxide were added at the following rates:

17.5 grams $CO_2$ at 0.295 grams/minute
2.4 grams $CO_2$ at 0,224 grams/minute
2.8 grams $CO_2$ at 0.183 grams/minute
2.8 grams $CO_2$ at 0.140 grams/minute
2.8 grams $CO_2$ at 0.061 grams/minute Upon completion of the carbonation step, the system was heated to 93° C. over a 2 hour period and then heated to 132° C. over a 30 minute period. At this point, 155 grams of diluent oil, CitCon 100N, was added and the system heated to 204° C. over 1.5 hours under vacuum to strip of the xylene. The resulting solution was then filtered over Celite TM (diatomaceous earth available from Manville Corporation) so as to provide an overbased carbon dioxide containing alkylphenoxy sulfonate additive composition having a TBN of about 200, a viscosity at 100° C. of 166 cSt (average of 2 runs —108 cSt and 223 cSt respectively), and 1.8% Ca-S by Hyamine analysis.

Example 4

Preparation of Overbased Sulfurized Carbon Dioxide Containing Alkylphenoxy Sulfonate Additive Composition Lime (74 grams), sulfur (17 grams), decanol (214 grams) and diluent oil (211 grams Chevron 100, available from Chevron USA, Inc., Richmond, Calif.) were combined and heated to 180° F. (82° C.). At this point, 165 grams of alkylphenoxy sulfonic acid, prepared in a manner similar to steps (a) and (b) of Example 1 above, were added over a 20 minute period and then the reaction mixture was stirred for an additional 10 minutes. Afterwards, 43 grams of ethylene glycol were added dropwise to the reaction system over a 45 minute period. The system was then heated to 350° F. (176.6° C.) and maintained at this temperature for 40 minutes.

At this time, the carbonation of this system was initiated by bubbling $CO_2$ into the system at a rate of 0.12 grams/minute for a total duration of 30 minutes and then an additional 17.9 grams of $CO_2$ was added to the system at a rate of 0.175 gram/minute so as to provide a total amount of 21.5 grams of $CO_2$, Afterwards, the reaction was heated to 410° F. and stripped at 25 millibar pressure for 15 minutes and then filtered through Celite TM.

The resulting overbased sulfurized alkylphenoxy sulfonate additive composition of this example has a TBN of 176, a calcium content of 8.79% and a viscosity of 66 cSt at 100° C.

As is apparent from Examples 1–4, the neutral and overbased alkylphenoxy sulfonates of this invention are prepared in the absence of other additives such as salicylates and, accordingly, the resulting additive composition is free of salicyclates.

Example 5

Stability of Substantially Straight-Chain Alkylphenoxy Sulfonic Acid

This example evaluates the stability of substantially straight-chain alkylphenoxy sulfonic acid to thermal desulfonation as compared to the degree of thermal desulfonation resulting from branched alkylphenoxy sulfonic acid. Specifically, this example evaluates the thermal stability of a straight-chain alkylphenoxy sulfonic acid which was prepared by first alkylating phenol with an alpha olefin mixture comprising alpha olefins of from 20 to 24 carbon atoms in the presence of Amberlyst TM 36 catalyst resin. The resulting alkylphenol comprises at least 10% dialkyl substitution, i.e., n in formula I is at least 1.1. The alkylphenol was then converted to its sulfonic acid by contacting the alkylphenol with 1.03 equivalents of $SO_3$ using conventional methods, i.e., either a batch method similar to that of step (b) of Example 1 or a standard falling film process. This compound is hereafter referred to as Compound I.

The thermal stability of this sulfonic acid was compared to an alkylphenoxy sulfonic acid obtained in a manner similar to that of Compound I except that this compound employed an alkylphenol derived from propylene tetramer. This compound contains about 27% tertiary carbon atoms in the alkyl group other than at the point of attachment to the phenolic ring and, accordingly, is not a substantially straight-chain alkyl substituent. This compound is hereafter referred to as Compound II.

The stability of Compound I and Compound II against spontaneous desulfonation was measured by placing a sample of each compound in a temperature controlled oven at about 66° C. (150° F.). The sample was maintained in the oven for 24 hours and 48 hours and, at each interval, the sulfonic acid content was determined titrimetrically as the weight percent calcium as sulfonate following the published procedure of Yamaguchi et al., Journal of the American Oil Chemists Society, Volume 55, page 359 (1977). The results of this analysis are set forth in Table III below:

TABLE III

| | Wght. % Calcium as Sulfonate | | | |
|---|---|---|---|---|
| Compound No. | 0 hours | 24 hours | 48 hours | % Loss[1] |
| I | 3.65 | 3.36 | 3.28 | ~10% |
| II | 4.56 | 3.13 | 2.58 | ~43% |

[1]% Loss is determined by subtracting the weight percent calcium as sulfonate at 48 hours from that at 0 hours; dividing this result by weight percent calcium as sulfonate at 0 hours and multiplying this result by 100.

The above results demonstrate that the amount of the sulfonic acid group retained in the alkylphenoxy sulfonic acid is substantially greater for Compound I as compared to Compound II and, accordingly, this data substantiates that alkylphenoxy sulfonic acids containing a substantially straight-chain alkyl group are more stable against spontaneous desulfonation as compared to alkylphenoxy sulfonic acids containing a branched chain alkyl group.

While the invention has been described in terms of various preferred embodiments, the skilled artisan will appreciate that various modifications, substitutions, omissions, and changes may be made without departing from the spirit thereof. Accordingly, it is intended that the scope of this invention be limited solely by the scope of the following claims, including equivalents thereof.

What is claimed is:

1. A lubricating oil soluble, low viscosity, neutral and low overbased alkylphenoxy sulfonate additive composition having a viscosity of no more than about 1000 cSt at 100° C. when the composition contains 40 weight percent of diluent oil wherein said diluent oil has a viscosity of about 2 to about 10 cSt at 100° C. and further wherein the alkyl group(s) on the alkylphenoxy sulfonate are substantially straight chain.

2. An additive composition according to claim 1, wherein the neutral and low overbased alkylphenoxy sulfonate additive composition comprises an alkylphenoxy sulfonate derived from alkylated phenols of the Formula I:

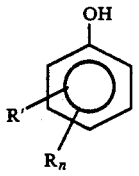

(I)

wherein

R is a substantially straight-chain alkyl group containing a sufficient number of carbon atoms to render the resulting neutral or overbased alkylphenoxy sulfonate oil-soluble;

R' is hydrogen or a substantially straight-chain alkyl group of from 1 to about 7 carbon atoms; and n is a number sufficiently greater than 1 so that when the neutral alkylphenoxy sulfonate additive composition contains 40 weight percent of diluent oil, it has a viscosity of no greater than about 1000 cSt at a temperature of 100° C.

3. An additive composition according to claim 2, wherein R is an alkyl group having at least 8 carbon atoms.

4. An additive composition according to claim 3 wherein R is an alkyl group having at least 18 carbon atoms.

5. An additive composition according to claim 2 wherein n is a number sufficient to provide an essentially neutral alkylphenoxy sulfonate having a viscosity no greater than about 500 cSt at a temperature of 100° C.

6. An additive composition according to claim 1 wherein said neutral and overbased alkylphenoxy sulfonates have a viscosity which is no greater than about 250 cSt at a temperature of about 100° C.

7. An additive composition according to claim 2 wherein the neutral and low overbased alkylphenoxy sulfonate additive composition is a low overbased alkylphenoxy sulfonate additive composition having a TBN which is no greater than about 100.

8. An additive composition according to claim 7 which are overbased so as to have a TBN which is no greater than about 50.

9. An additive composition according to claim 2 which are neutralized or overbased with a Group II metal base.

10. An additive composition according to claim 9, wherein said Group II metal base is a calcium base.

11. An additive composition according to claim 2, wherein R is an alkyl group having an internal attachment.

12. An additive composition according to claim 1 wherein the alkyl group is derived from an internal olefin.

13. A method for reducing the viscosity of a lubricant additive composition comprising neutral and low overbased alkylphenoxy sulfonates which method comprises the steps of:

(a) preparing an alkylphenol composition containing a dialkyl content of at least 10 percent wherein the alkyl group(s) of the alkylphenol are derived from substantially straight-chain olefins or alcohols having a sufficient number of carbon atoms to impart oil solubility to the alkylphenol;

(b) sulfonating the alkylphenol composition prepared in step (a) above so as to produce an alkylphenol sulfonic acid; and (c) reacting the product of step (b) with a sufficient amount of an alkaline earth metal base so that the resulting product has a TBN from 0 to about 100.

14. The method according to claim 13 wherein the alkyl group(s) has (have) at least 8 carbon atoms.

15. The method according to claim 14 wherein the alkyl group(s) has (have) at least 18 carbon atoms.

16. The method according to claim 13 wherein the alkylphenol composition contains a dialkyl content of at least 15 percent.

17. The method according to claim 13 wherein the neutral and low overbased alkylphenoxy sulfonate additive composition is a low overbased alkylphenoxy sulfonate additive composition having a TBN which is no greater than about 100.

18. The method according to claim 17 which are overbased so as to have a TBN which is no greater than about 50.

19. The method according to claim 13 wherein said overbased alkylphenoxy sulfonates have a viscosity which is no greater than about 250 cSt at a temperature of about 100° C.

20. The method according to claim 13 which are neutralized or overbased with a Group II metal base.

21. The method according to claim 20 wherein said Group II metal base is a calcium base.

22. The method according to claim 13 wherein the alkyl group has an internal attachment to the phenol group of the alkylphenol.

23. The method according to claim 13 wherein the alkyl group is derived from an internal olefin.

24. The method according to claim 13 which further comprises adding carbon dioxide to the product of step (c) so as to provide for a low overbased alkylphenoxy sulfonate, a moderately overbased alkylphenoxy sulfonate, or a highly overbased alkylphenoxy sulfonate.

25. The method according to claim 24 which further comprises sulfurizing said overbased alkylphenoxy sulfonate prior to addition of carbon dioxide.

26. The method according to claim 24 wherein the TBN of the resulting additive composition is about 100 or less.

27. The method according to claim 24 wherein the TBN of the resulting additive composition is about 100 to 300.

28. The method according to claim 24 wherein the TBN of the resulting additive composition is greater than 300.

29. The method according to claim 25 wherein the TBN of the resulting additive composition is about 100 or less.

30. The method according to claim 25 wherein the TBN of the resulting additive composition is about 100 to 300.

31. The method according to claim 25 wherein the TBN of the resulting additive composition is greater than 300.

32. A lubricating oil composition comprising an oil of lubricating viscosity and from about 0.1 to about 40 weight percent of a neutral or low overbased alkylphenoxy sulfonate additive composition according to claim 1.

* * * * *